US005403219A

United States Patent [19]

Ryan

[11] Patent Number: 5,403,219

[45] Date of Patent: Apr. 4, 1995

[54] LAUNCHABLE DIVER SURFACING SIGNAL

[76] Inventor: Wayne Ryan, 22 Upland St., Holbrook, Mass. 02343

[21] Appl. No.: 87,669

[22] Filed: Jul. 6, 1993

[51] Int. Cl.[6] ..... B63C 9/20

[52] U.S. Cl. ..... 441/11; 441/89; 116/173

[58] Field of Search ..... 441/1, 2, 11, 26, 32, 441/33, 89; 405/185, 186; 116/173, 174, 175, 209, 210

[56] References Cited

U.S. PATENT DOCUMENTS

| | | | |
|---|---|---|---|
| 3,005,215 | 10/1961 | Colt et al. | 441/26 |
| 3,547,073 | 12/1970 | Colandrea | 441/11 |
| 3,872,529 | 3/1975 | Wainwright . | |
| 4,144,606 | 3/1979 | McIntyre | 441/11 |
| 4,224,707 | 9/1980 | Mariani | 441/11 |
| 4,796,553 | 1/1989 | Cogswell et al. . | |
| 5,067,920 | 11/1991 | Brisky . | |
| 5,114,369 | 5/1992 | Coffey | 441/11 |

*Primary Examiner*—Stephen P. Avila
*Attorney, Agent, or Firm*—Choate, Hall & Stewart

[57] ABSTRACT

A diver surfacing signal that can be conveniently carried underwater in a launching tube that is strapped to a diver's tanks and released by the diver prior to surfacing in order to alert marine vehicles to the diver's presence. Prior to surfacing, the diver releases the surfacing signal from the launching tube by the depression of a button, and the surfacing signal remains linked to the diver by a flexible line. The flexible line functions to keep the surfacing signal in the vicinity of the diver, and can be used to retrieve the surfacing signal after the diver has come to the water surface and has moved to a safe location.

8 Claims, 2 Drawing Sheets

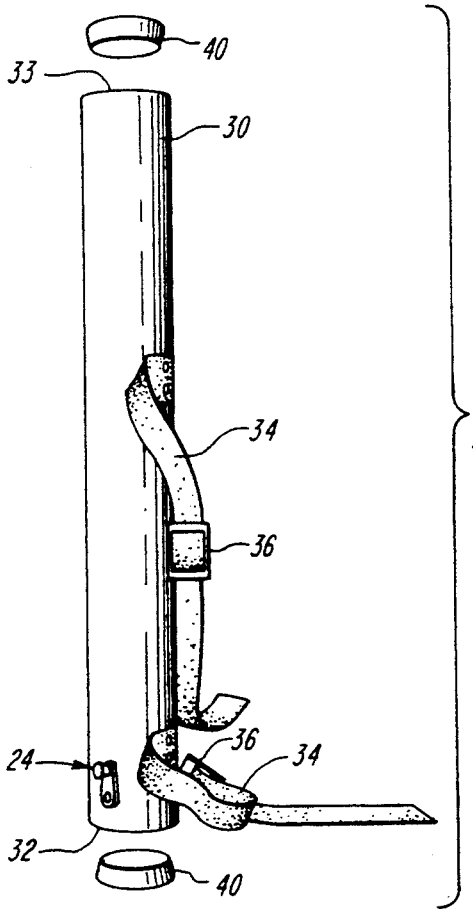
FIG. 2
FIG. 3
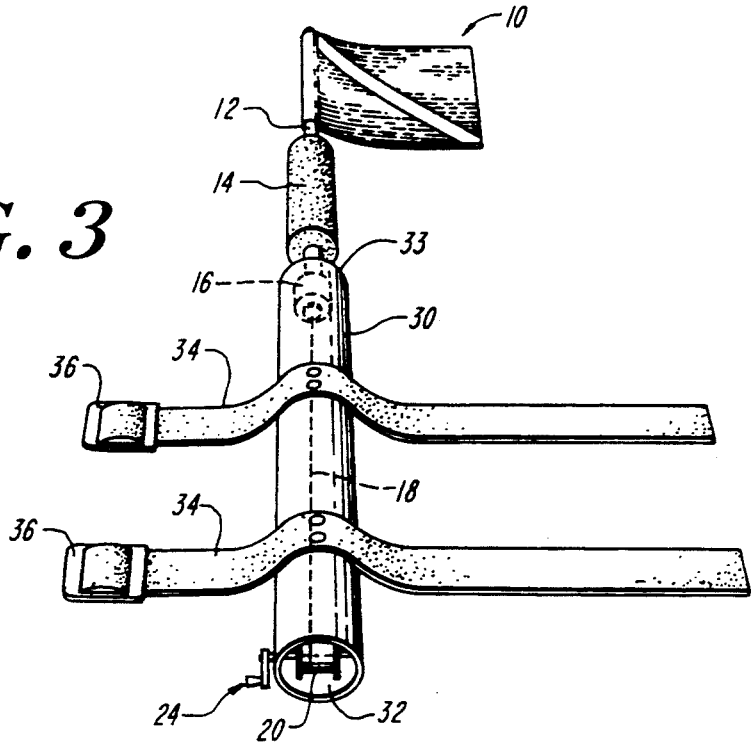

LAUNCHABLE DIVER SURFACING SIGNAL

BACKGROUND OF THE INVENTION

The invention relates to a signal flag that is used by scuba divers to warn boats of a diver who is operating underwater.

Scuba divers often utilize a buoy or other marker as a reference point on the surface of the water. These markers can be tethered to a boat, or can be tethered to the diver. Often the marker is tethered to the diver in order to signal the presence of a diver under the water. The tethering of a marker to a diver has an inherent difficulty in that the diver must carry about a tether line, and must be careful to not tangle the tether line with himself, other divers, or underwater objects.

It may be appreciated that the carrying of a tether line by a diver can be difficult in many situations, for example when a diver is exploring an underwater reef or cave. Also, a diver who is diving in a location that renders the carrying of a tether line impractical may wish to surface in open water and then swim to a nearby boat, rather than need to surface close to the boat. Even under standard diving conditions, a diver may prefer to not be hampered by a tether line during the dive. However, it is necessary to alert marine vehicles to the presence of a diver prior to the surfacing of a diver such that the vicinity of the diver can be avoided by the marine vehicles.

SUMMARY OF THE INVENTION

I have invented a diver surfacing signal that can be conveniently carried underwater by a diver and released by the diver prior to surfacing in order to alert marine vehicles to the diver's presence. This surfacing signal is carried underwater by the diver in a launching tube that is attached to the diver's tanks. When the diver desires to surface, the surfacing signal is released from the launching tube by the depression of a button, and the surfacing signal remains linked to the diver by a flexible line. The flexible line functions to keep the surfacing signal in the vicinity of the diver, and can be used to retrieve the surfacing signal after the diver has come to the water surface and has moved to a safe location.

This diver surfacing signal avoids the problems of the currently used signal devices in that the diver need not carry a tether line which is linked to a signal on the water surface while the diver swims under the water surface.

DESCRIPTION OF THE PREFERRED EMBODIMENTS

Drawings

FIG. 2 is a side view of the launchable diver surfacing signal when contained within the launcher tube.

FIG. 3 is a side view of the surfacing signal and the launcher after the release of the surfacing signal from the launcher.

Structure of Launchable Diver Surfacing Signal

Figure 1:
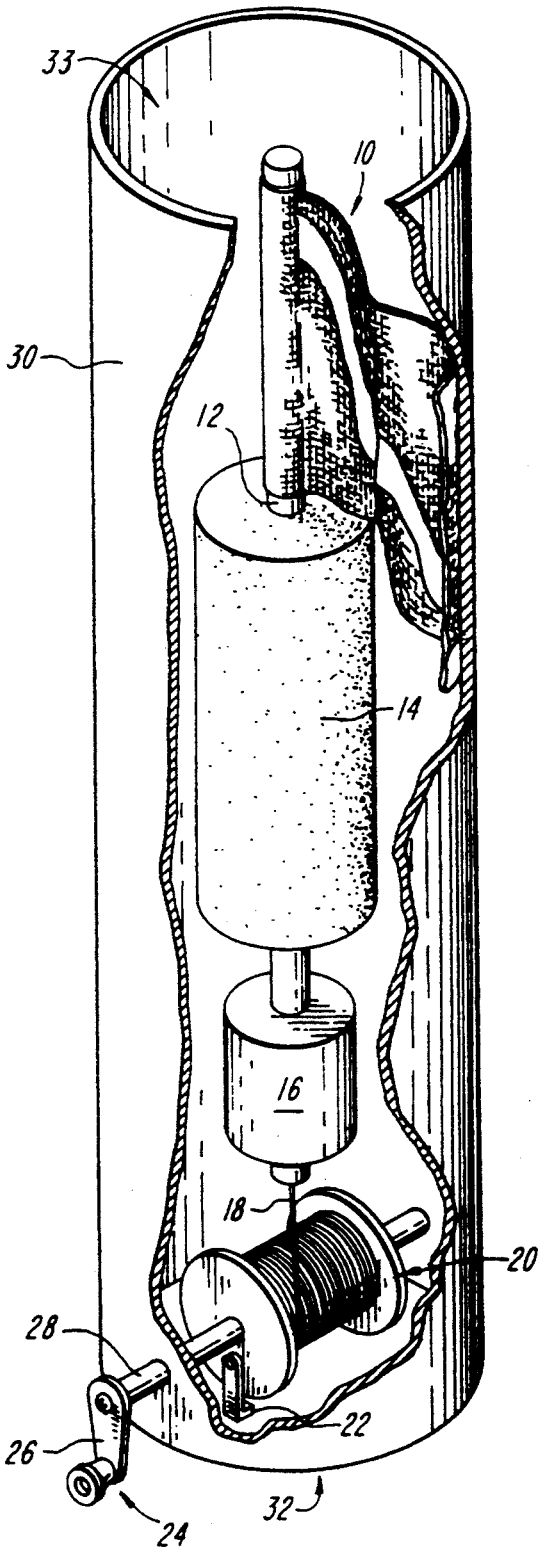
FIG. 1 is a schematic view of the surfacing signal and reel disposed within a cutaway view of the launcher.

A description of the launchable diver surfacing signal is provided below, with reference to the drawings, and in particular to FIGS. 1 and 3. Briefly, a signal 10 is attached to one end of a resiliently rigid pole 12, a positively buoyant floatation device 14 is attached to the center portion of the pole, and a counterweight 16 is attached to the end of the pole opposite the signal 10. A flexible line 18 is secured to the counterweight, or to the end of the pole nearest the counterweight, and the flexible line 18 is also attached to a reel device 20. The reel device 20 has a release button 22 for allowing free unwinding of the flexible line from the reel device, and a handle 24 for manually rewinding the flexible line, or other suitable means for rewinding the flexible line. The reel device 20 is secured to the interior portion of the launcher 30 which has openings 32, 33 at either end. The release button 22 is easily accessible through the opening at the bottom end 32 of the launcher 30, and the depression of the release button 22 will allow the flexible line 18 to unwind, thus allowing the surfacing signal, (10, 12, 14, 16) to exit from the launcher through the top opening 33. The handle 24 is disposed with the crank portion 26 on the outside of the launcher with a shaft portion 28 piercing the launcher 30 and communicating with the reel device 20. Once the diver has surfaced, the handle 24 can be used to rewind in the flexible line 18 onto the reel device 20. Straps 34, shown in FIGS. 2 and 3, having fasteners 36 are affixed to the outside of the launcher 30 for securing the launcher, containing the surfacing signal, to the air tanks of a diver (not shown). The bottom and top openings 32, 33 can be covered during transport and storage with caps 40, as seen in FIGS. 2 and 3. The caps 40 will function to keep the surfacing signal clean and contained during transport and storage, but should be removed prior to entering the water.

As shown in FIGS. 1 and 3, the signal 10 can be a dive flag or other signal device such as a brightly marked ball, a flashing light, an audible signal, or a combination of these signal devices. A flag is the preferred signal device, and can be made from marine vinyl, cloth, nylon, plastic, stiff netting, or any appropriate material that can be colored such that it will stand out and be easily recognized by the occupants of marine vehicles. The size of the flag is chosen such that it will conveniently fit into the launcher, and should be at least one square foot in size.

The signal 10 is mounted upon a resiliently rigid pole 12, see FIGS. 1 and 3, which can be made of plastic, a synthetic resin polymer, such as TEFLON® a glass fiber product, such as FIBERGLASS®, a synthetic resin polymer, such as PLEXIGLASS®, or other suitable material that is rigid yet resilient and somewhat flexible. Preferably the pole 12 is approximately ½ inches in diameter, 25 inches in length, and is of a fluorescent color to augment visibility of the surfacing signal. If the signal is a flag, then the flag and pole can also include a spring attachment, as is well known in the art, which will encourage the flag to stand out from the pole such that the flag is more visible.

The positively buoyant floatation device 14, shown in FIGS. 1 and 3, can be compressed styrofoam, polyethylene foam, polyurethane foam, dow ethafoam (a closed cell positively buoyant foam available from United Foam Plastics) or any suitable non-water absorbing positively buoyant material. The size of the floatation device 14 will depend upon the interior size of the launcher 30, and in preferred embodiments, the floatation device 14 is 2–3 inches in diameter, and 6–12 inches in length. The floatation device 14 is preferably attached to the pole 12 by passing the pole 12 through the center of the float. The floatation device 14 can be either fixed at a specific point on the pole 12 by adhering the float to the pole 12, such as with glue, or can be allowed to travel freely between the flag 10 and the counterweight 16.

The counterweight 16, shown in FIGS. 1 and 3, can be made of any suitable heavy material which can be attached to the end of the pole. In a preferred embodiment, the counterweight 16 is a stainless steel or a lead weight, such as a 1 lb. fishing weight, that has a recessed portion in one end for engaging the pole 12. The recessed portion of the weight can be formed by milling out an area at one end of the weight that is of a sufficient dimension to receive the rod. The pole can be affixed in the recessed portion of the counterweight using suitable means, such as a cotter pin, as is known in the art. It is also preferred that the counterweight 16 have an aperture to which the flexible line 18 can be secured.

As is shown in FIGS. 1 and 3, the flexible line 18 is secured to the counterweight 16 at one end of the line and to the reel device 20 at the other end of the line. The flexible line 18 is preferably made of heavy test, salt water resistant material, that is visible in water. Heavy test line is line that has a rating of at least 20 lb. test. Preferably the line 18 is fluorescent in color. The flexible line 18 is also preferably 100–200 feet in length, thus allowing sufficient length of line such that the surfacing signal can reach the surface of the water at a time significantly ahead of the surfacing of the diver. The presence of the surfacing signal will alert marine vehicles to the presence of the diver under the water, and of the diver's impending surfacing.

The reel device 20, shown in FIG. 1, preferably has a button 22 for releasing the flexible line 18 such that the line can freely unwind from a spool that is contained within the reel, and a handle 24 for rewinding the flexible line 18 into the reel device 20. In preferred embodiments the reel device 20 is a fishing reel, such as a Zebco Model No. 303 or Model No. 404 fishing reel. The reel device 20 is secured within the launcher 30 by affixing the reel to the interior of the launcher with screws, rivets or other suitable hardware. The reel 20 is secured within the launcher such that the release button 22 is slightly recessed into the launcher 30, and the release button 22 is freely accessible to the diver's fingers through the bottom opening 32 of the launcher 30. The handle 24 is made accessible to the user by making a hole in the side of the launcher 30, and passing the shaft 28 of the handle through the hole and into engagement with the reel device, leaving the crank 26 disposed on the exterior of the launcher 30. Depression of the release button 22 allows free unwinding of the flexible line 18. Depending upon the reel device 20 used, the handle 24 must be turned once the surfacing signal has reached the surface so that the line will not unwind completely from the reel device and come free of the reel device.

The launcher 30, shown in FIGS. 1, 2, and 3, is preferably a hollow tube that is 3–4 inches in diameter, and has openings at either end. The launcher 30 is preferably constructed to be slightly longer than scuba diving tanks, such that the surfacing signal is not inadvertently caught in the diver's gear while the surfacing signal is being deployed. The launcher 30 is preferably constructed from heavy plastic or polymer tubing, for example polyvinylchloride or chlorinated polyvinylchloride tubing or any suitable salt water resistant material. The launcher 30 can be provided with caps 40 for the closing of either end. The caps 40 are shown next to the launcher in FIGS. 2 and 3. The closing of the launcher with caps would be useful for storage and travel. The caps 40 would be removed prior to entering the water by the diver so that the openings are not blocked. The caps 40 can be made from the same material as the launcher tubing, or can be made from rubber or other suitable materials.

As is shown in FIGS. 2 and 3, the straps 34 are affixed to the outside of the launcher 30 by means of rivets, grommets, screws, glue, or a combination of these fastening means. In FIG. 3, rivets 42 are shown as the means to fasten the straps to the launcher. The straps 34 can be constructed from a suitable salt water resistant material, such as nylon webbing. The fasteners 36 can be any of a variety of buckles and clasps, or velcro, which will provide a secure attachment of the surfacing signal and launcher to diving tanks. The fasteners 36 can be attached to the ends of the straps by sewing or gluing as is suitable for the type of fastener chosen. Preferably, two straps 34 with fasteners 36 are attached to the launcher 30 as is shown in FIGS. 2 and 3. The straps 34 are preferably 2–3 inches wide and of sufficient length to be fastened about a diving tank. More than two straps could also be used if desired, and the straps used could easily be of a different width than the preferred width.

Use of the Launchable Diver Surfacing Signal

In use, the launchable diver surfacing signal is attached to a diver's tanks prior to entering the water. The caps are removed from either end of the launcher in order to allow free access to the surfacing signal through the openings. While under the water, the diver can swim freely and the surfacing signal and launcher will not impede the divers movements as would a tether line for a buoy. At the end of the dive, but prior to surfacing, the diver will deploy the surfacing signal. The diver will orient himself such that the top opening of the launcher is facing towards the surface of the water, and the surfacing signal is then deployed by pushing the release button on the reel, thus freeing the flexible line. The free unwinding of the flexible line allows the positive buoyancy of the floatation device to push the surfacing signal through the top opening of the launcher and to float to the surface of the water. Once on the surface of the water, the signal flag will be held above the water by the positively buoyant floatation device and will be held upright by the counterweight. The diver can now safely surface. Once the diver has returned to his boat, or otherwise removed himself from the path of marine vehicles, the handle of the reel can be used to rewind the line and repackage the surfacing signal into the launcher.

As will be apparent to those of ordinary skill in the art, the invention provides for an effective surfacing signal for an underwater diver, and avoids the need to tow such a signal about during the dive by means of a tether line.

Other Embodiments

The launchable diver surfacing signal is a combination of several parts, and each of the parts contribute to the invention. Many equivalent parts could be used in place of the parts described in the description of the invention and the resultant launchable surfacing signal would remain within the spirit of the invention.

The launchable diver surfacing signal can also be used as a distress signal to alert the diver's associates that the diver needs help. To use the launchable signal flag as a distress signal, the diver would prearrange with his associates an action which would alert them to his trouble. For example, the diver could launch the surfacing signal, and then pull on the line to cause the surfacing signal to move significantly at the surface, or when using a flag that has a spring attachment, the diver could disable the spring attachment such that the flag would not stand away from the pole when on the surface of the water.

What is claimed is:

1. An underwater launchable signal device to warn marine vehicles away from the vicinity of an underwater diver comprising:

a launcher adapted for use underwater, said underwater launcher having, means for attachment to gear worn by an underwater diver;

a surfacing signal disposed within said underwater launcher comprising, a warning signal member, a floatation member, a counterweight member and a pole, wherein said warning signal member and said counterweight member are attached at opposite ends of said pole and said floatation member is attached to a central portion of said pole, wherein said counterweight member is a stainless steel weight or a lead weight;

a flexible line, said line ,having two terminal ends, one terminal end attached to said counterweight member and the other terminal end attached to a reel device;

said reel device disposed within said underwater launcher and attached to said underwater launcher, said reel device including a release button to allow unwinding of said line from said reel device and a handle for rewinding said line into said reel device;

whereby depression of said release button allows said line to unwind from said reel device and said surfacing signal to exit said underwater launcher and to travel to the surface of the water, said surfacing signal thus providing a warning to approaching marine vehicles that an underwater diver is nearby.

2. An underwater launchable signal device to warn marine vehicles away from the vicinity of an underwater diver comprising:

a launcher adapted for use underwater, said underwater launcher having means for attachment to gear worn by an underwater diver;

a surfacing signal disposed within said underwater launcher comprising, a warning signal member, a floatation member, a counterweight member and a pole, wherein said warning signal member and said counterweight member are attached at opposite ends of said pole and said floatation member is attached to a central portion of said pole, wherein said pole is made of plastic, a synthetic resin polymer, or a glass fiber product;

a flexible line, said line having two terminal ends, one terminal end attached to said counterweight member and the other terminal end attached to a reel device;

said reel device disposed within said underwater launcher and attached to said underwater launcher, said reel device including a release button to allow unwinding of said line from said reel device and a handle for rewinding said line into said reel device;

whereby depression of said release button allows said line to unwind from said reel device and said surfacing signal to exit said underwater launcher and to travel to the surface of the water, said surfacing signal thus providing a warning to approaching marine vehicles that an underwater diver is nearby.

3. An underwater launchable signal device to warn marine vehicles away from the vicinity of an underwater diver comprising:

a launcher adapted for use underwater, said underwater launcher having means for attachment to gear worn by an underwater diver, wherein said launcher is made of polyvinylchloride or chlorinated polyvinylchloride;

a surfacing signal disposed within said underwater launcher comprising, a warning signal member, a floatation member, a counterweight member and a pole, wherein said warning signal member and said counterweight member are attached at opposite ends of said pole and said floatation member is attached to a central portion of said pole;

a flexible line, said line having two terminal ends, one terminal end attached to said counterweight member and the other terminal end attached to a reel device;

said reel device disposed within said underwater launcher and attached to said underwater launcher, said reel device including a release button to allow unwinding of said line from said reel device and a handle for rewinding said line into said reel device;

whereby depression of said release button allows said line to unwind from said reel device and said surfacing signal to exit said underwater launcher and to travel to the surface of the water, said surfacing signal thus providing a warning to approaching marine vehicles that an underwater diver is nearby.

4. The launchable signal device of claims 1, 2, or 3 wherein said means for attachment of said launcher to said gear is a plurality of straps having fasteners.

5. The launchable signal device of claims 1, 2, or 3 wherein said warning signal member is a flag.

6. The launchable signal device of claims 1, 2, or 3 wherein said flotation member is made of closed sell positively buoyant foam, polyurethane foam or polyethylene foam.

7. The launchable signal device of claims 1, 2, or 3 wherein said flexible line is heavy test, salt water resistant fishing line.

8. The launchable signal device of claims 1, 2, or 3 wherein said reel device is a fishing reel.

* * * * *